United States Patent [19]

Farnsworth et al.

[11] Patent Number: 4,965,984

[45] Date of Patent: Oct. 30, 1990

[54] METHOD AND APPARATUS FOR ALIGNING ELONGATED ARTICLES

[75] Inventors: Richard Farnsworth, Portland, Oreg.; Donald Deines; Alvin Deines, both of Pasco, Wash.

[73] Assignee: Package Machinery Corporation, Oakland, Calif.

[21] Appl. No.: 412,763

[22] Filed: Sep. 1, 1989

Related U.S. Application Data

[63] Continuation-in-part of Ser. No. 256,045, Oct. 11, 1988, abandoned.

[51] Int. Cl.[5] ..... B65B 19/34; B65B 35/56

[52] U.S. Cl. ..... 53/444; 53/446; 53/148; 53/544; 53/236; 53/247; 198/397

[58] Field of Search ..... 53/444, 446, 148, 544, 53/443, 236, 247; 198/703, 754, 766, 397

[56] References Cited

U.S. PATENT DOCUMENTS

| | | | |
|---|---|---|---|
| 3,641,735 | 2/1972 | Daily et al. . | |
| 3,791,513 | 2/1974 | Barlow . | |
| 4,031,999 | 6/1977 | Wagner et al. | 53/444 X |
| 4,054,015 | 10/1977 | Rowell | 53/444 X |
| 4,183,192 | 1/1980 | Smaw | 53/444 |
| 4,250,687 | 2/1981 | Lueneberg et al. | 53/444 X |
| 4,514,959 | 8/1986 | Maglecic . | |
| 4,586,313 | 5/1986 | Maglecic . | |
| 4,607,478 | 8/1986 | Maglecic . | |

*Primary Examiner*—Horace M. Culver
*Attorney, Agent, or Firm*—McCormick, Paulding & Huber

[57] ABSTRACT

A novel method and apparatus for aligning elongated articles, such as french fried potatoes, includes a bucket for receiving a charge of the articles. Configured with the bucket is a conveyor having an endless belt with a plurality of spaced flights that each receive a portion of the charge. The articles are aligned by the conveyor and presented to a collector bucket configured to store the aligned charge portions prior to discharge to a bagging machine.

37 Claims, 5 Drawing Sheets

METHOD AND APPARATUS FOR ALIGNING ELONGATED ARTICLES

This is a continuation-in-part of co-pending application Ser. No. 256,045 filed on Oct. 11, 1988, abandoned.

TECHNICAL FIELD

This invention relates to a packaging method and apparatus and more particularly to a method and apparatus for aligning elongated articles such as french fries.

BACKGROUND OF THE INVENTION

Packaging techniques for bulk materials are well known in the art. However, specific problems are presented when packaging those articles, such as french fries, which are elongated. Conventional packaging techniques result in random placement of the articles in the container and yield packaging costs which are increased due to the larger volume needed to otherwise package the same amount of articles if those articles were aligned. In addition, a greater area is required for shipping and handling which further increase cost.

As hand alignment of elongated articles is not feasible, several machines have been developed which align the articles prior to packaging. U.S. Pat. No. 4,586,313 discloses a method and apparatus for packaging elongated pieces characterized by a horizontal, planar series of pans in which french fries or other articles are moved from pan to pan and aligned with their longitudinal axis parallel to one another by the action of a plurality of vibrators. As the individual pieces are aligned, they fall into a weighing bucket which has an electronically controlled retention flap that will provide the aligned french fries into a bagging machine when a full charge is received.

U.S. Pat. No. 4,514,959 discloses another method and apparatus for aligning and packaging elongated articles. This device aligns the articles in two steps. Initially, the randomly oriented articles, such as french fries, are horizontally provided on a vibrating conveyor. At a distal end of the conveyor, there are a number of channels which receive the advancing french fries. The channels are configured so that the articles must advance with their elongated dimension parallel to the channel length. These channels are positioned at a preselected angle with respect to a discharge chute. When the french fry is presented to the end of the channel towards the discharge chute it is turned further to be parallel with the length of the discharge chute. The french fries will then drop through the chute into a weighing device and on to a bagging machine.

It would be advantageous to have a method and apparatus for aligning a charge of elongated articles at increased speeds and with simplified components at a lower cost. The present invention is drawn towards such a method and apparatus.

SUMMARY OF THE INVENTION

An object of the present invention is to provide a method and apparatus for aligning a charge of elongated articles with a minimum of components.

According to the present invention an apparatus for aligning a charge of elongated articles before presentation to a bagging machine includes a bucket that receives the charge, and a conveyor having a plurality of spaced flights, each of which is adapted to receive a portion of the charge from the receiver bucket at a first conveyor position. The conveyor advances the charge portion on each of the flights to a conveyor second position with the articles of the charge portion having the elongated dimension thereof substantially parallel to a longitudinal axis of the flights. Also included is a collector bucket for receiving the aligned charge portions at the conveyor second position. The collector stores the received portion in alignment with the flight longitudinal axis. The apparatus further has a mechanism for discharging the charge to the bagging machine when the collector bucket has received all of the charge.

According to another aspect of the present invention a system for aligning a charge of elongated articles before presentation to a bagging machine includes a plurality of alignment devices configured in an array. The array has a first position for receiving the charge and a second position for discharging the charge into the bagging machine. Each device includes a bucket for receiving the charge, and a conveyor having a plurality of spaced flights each of which are adapted to receive a portion of the charge from the receiver bucket at a first conveyor position. The conveyor provides for advancing the charge portion on the flights to a conveyor second position with the articles of the charge portion having the elongated dimension thereof substantially parallel to a longitudinal axis of the flights. A collector bucket receives the aligned charge in a selected time period and retains the received charge in alignment with the flight longitudinal axis. Each device also includes a mechanism for selectively discharging the aligned and stored charge. A mechanism is also included for repetitively advancing each of the devices between the first and second array positions in a time period approximately equal to the collector time period, thereby allowing all of the received charge to be aligned and stored in the collector bucket before discharge to the bagging machine.

DESCRIPTION OF THE PREFERRED EMBODIMENT

Figure 1:
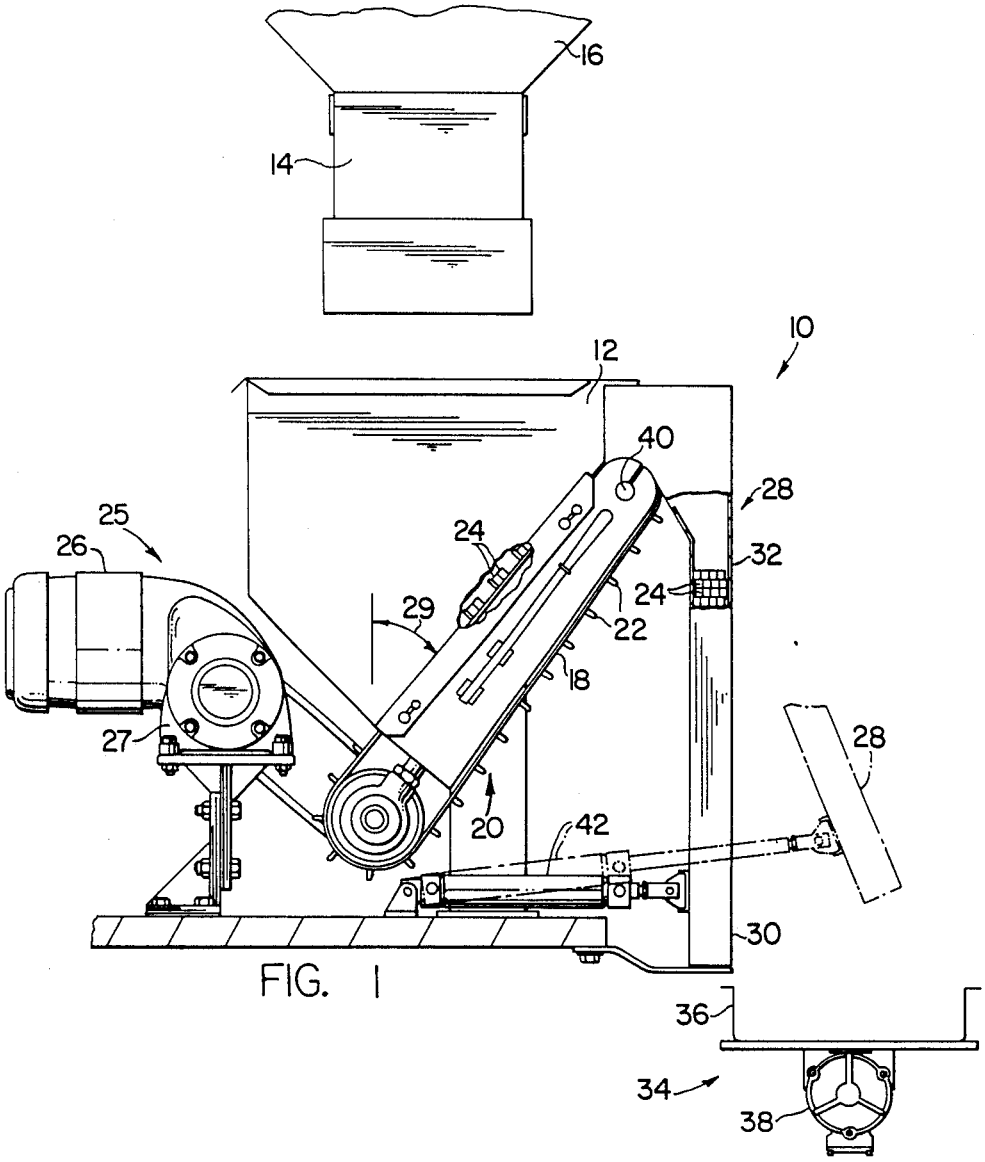
FIG. 1 is a sectioned illustration showing a portion of an alignment apparatus provided according to the present invention.
Figure 2:
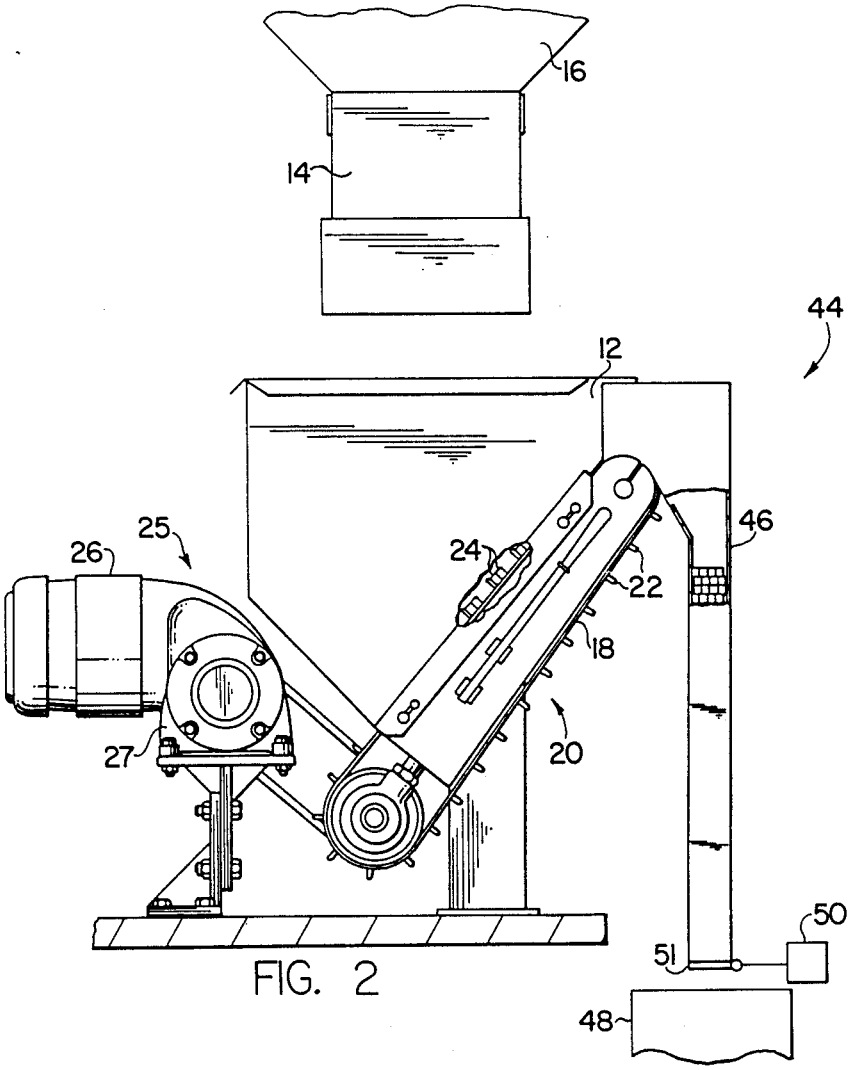
FIG. 2 is a simplified sectioned illustration showing an alternative embodiment of the apparatus of FIG. 1.

Referring now to FIG. 1, there is illustrated in section an alignment apparatus provided according to the present invention. The apparatus 10 includes a hopper or a bucket 12 which receives a charge from holding bucket 14. In a preferred embodiment, the charge is formed from scales 16 before presentation to bucket 14.

The charge is comprised of a plurality of elongated articles such as french fries. The unaligned articles are deposited in the hopper at random. A number of articles which comprise a portion of the charge are received on an endless belt 18 which comprises part of a conveyor 20. The conveyor includes a conventional belt driving mechanism 25 that includes a motor 26 and a reduction element 27 for driving belt 18. The belt is characterized by a number of spaced flights 22 that extend outward from the belt and which receive the individual articles 24. The conveyor is preferably positioned within the hopper 12 such that individual articles are directly received onto the conveyor flights. In the embodiment of FIG. 1, the conveyor is configured against or as part of the bucket wall to ensure that all of the articles deposited in the bucket are received by the conveyor.

It is important to note that the conveyor belt should be configured at an acute angle 29 with respect to the vertical in order for the articles to be aligned on the conveyor flights. In the embodiment of FIG. 1, the angle is approximately 40 degrees. For certain articles it may be preferable for the conveyor to comprise a vibrating belt.

The individual flights extend approximately the width of the conveyor belt. The flights should not extend outward from the conveyor belt so far as to encompass the height of two of the elongated articles. For french fries having a height of approximately ⅜ inches it is preferable that the height of the individual flights extend no more than ½ inch off of the conveyor belt. If the flight height is too great it is possible for misaligned articles to be presented to the collector. The spacing between flights is also of importance. In general, the closer the flights are spaced the greater the speed in which the articles of a charge will be aligned. Moreover, close spacing also improves the alignment capability of the apparatus, since there is less of a chance for a broken or mangled article to advance to the collector bucket. For the french fries described above, the flights can be spaced three inches apart, although a two inch spacing is preferable.

The aligned articles exit the conveyor-hopper assembly and are presented to a collector bucket 28 characterized by negative draft. That is, the width of the bucket is slightly greater at the bottom 30 than at the top 32 to prevent the articles from sticking when dropped. The speed of the conveyor belt is preferably such that the articles free-fall into the collector bucket.

The collector bucket will only present the aligned charge to a bagging machine 34 when all of the aligned charge portions are received by the collector bucket, a condition determined in a known manner, such as by an elapsed time period. The bagging machine 34 receives the aligned articles in a formed plastic pouch 36 which is vibrated by a vibrator 38. During article discharge, the collector bucket is swung about pivot 40. Note that the collector bucket and receiving bucket or hopper comprise "rigidized" materials in the preferred embodiment to prevent the articles from sticking to the interior of both buckets.

In a first alternative apparatus 44 the collector bucket 46 may discharge the articles to a vertical form, fill and seal (VFFS) bagging machine 48 of the type known in the art. For the apparatus 44, the aligned charge is discharged by means of a mechanism 50, that controls the operation of bucket doors 51.

Figure 3:
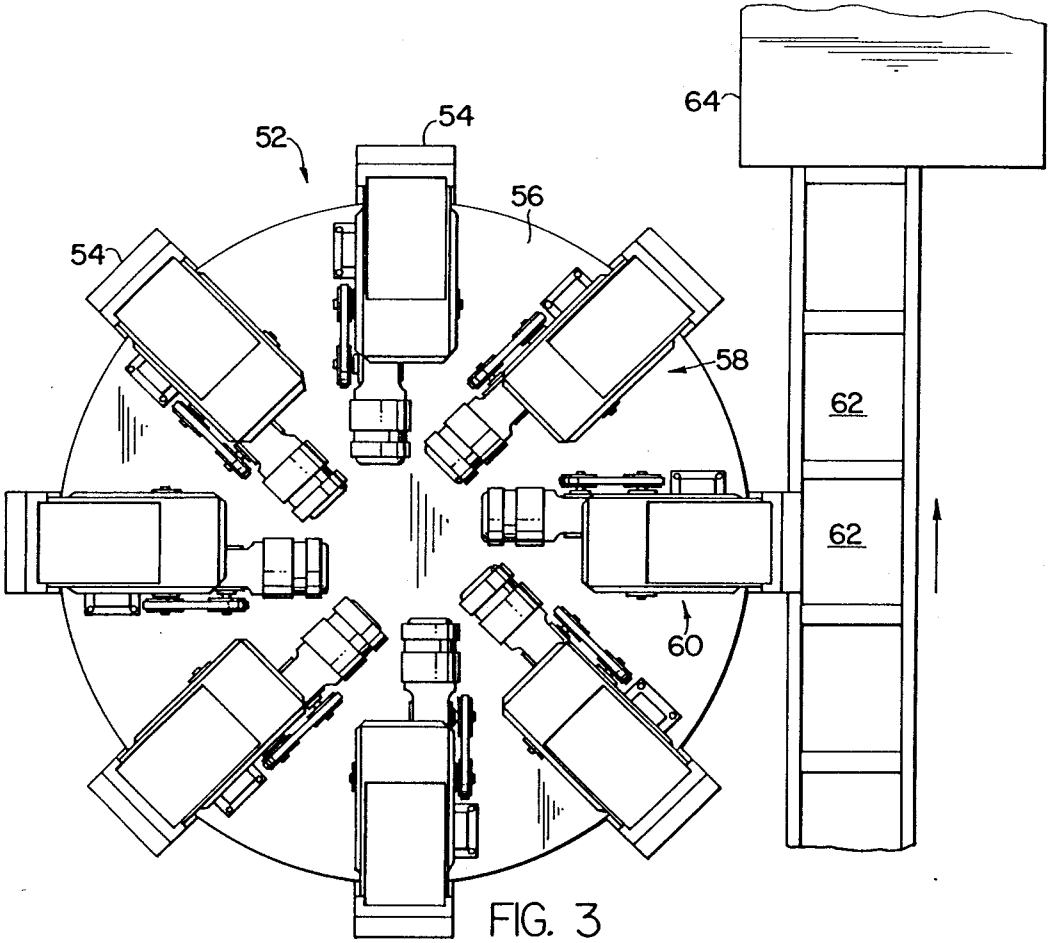
FIG. 3 is a top illustration of an alignment system for elongated articles including the apparatus of FIG. 1.

Referring now to FIG. 3, there is illustrated in top view a portion of an alignment system 52 provided according to the present invention. The alignment system 52 comprises a plurality of alignment apparatus 54, each preferably being an apparatus 10 of FIG. 1. Each apparatus is configured in an array on an indexing table 56. The array is characterized by two positions. In position 58, each apparatus receives a charge from a conventional scale or bucket (not shown). The apparatus is then indexed about the table in a time period which is selected to be greater than or equal to the time needed for a conveyor in an individual apparatus to align the articles in the corresponding alignment bucket.

Once the table has indexed to position 60, the contents of the collector bucket containing the aligned articles is discharged to pouch 62. The pouch receives the aligned charge and then is itself indexed along towards a packaging machine 64 of a known type.

Figure 4:
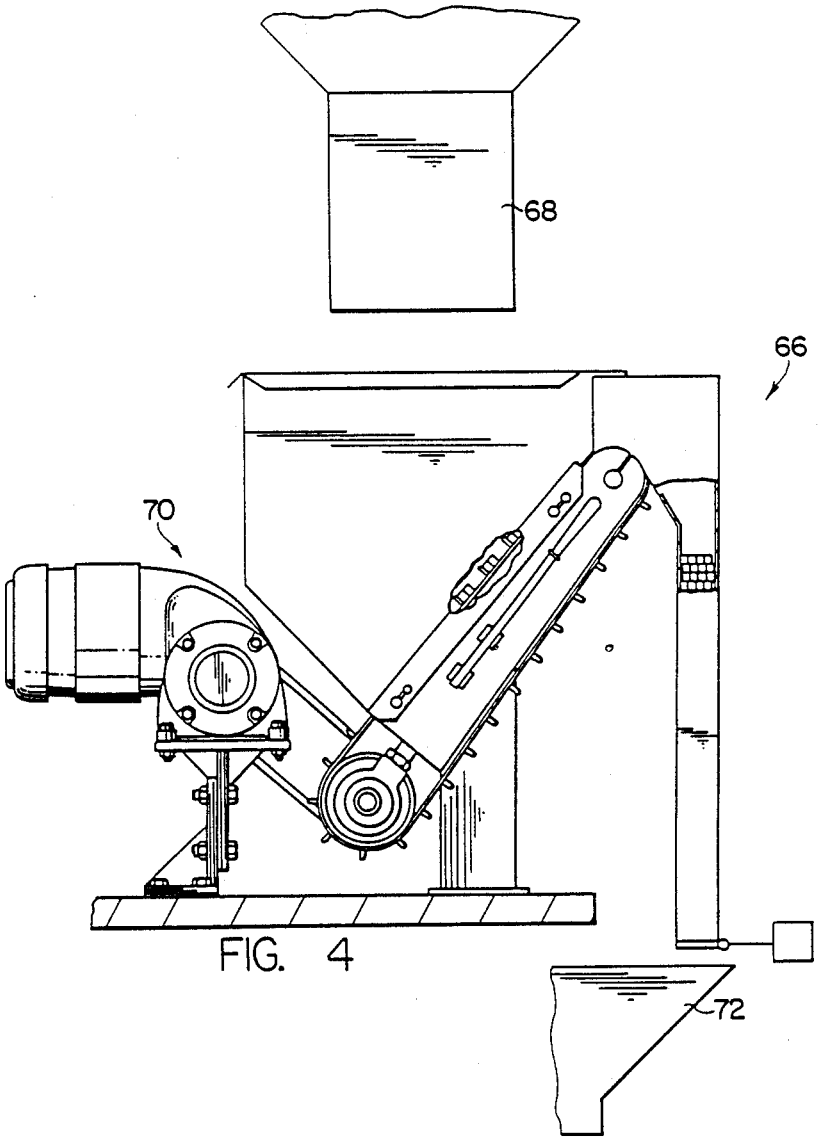
FIG. 4 is an illustration of a portion of an alternative alignment system provided according to the present invention.

Similarly, although the invention has been shown and described with respect to a preferred embodiment thereof, it should be understood by those skilled in the art that various other changes, omissions and additions thereto may be made therein without departing from the spirit and scope of the present invention. As shown schematically in FIG. 4, an alternative alignment system 66 comprises a moving chute 68 that provides charges of elongated articles to a fixed array of alignment device 70 and ultimately to chute 72 en route to a conventional bagging machine (not shown). Although shown and described hereinabove with respect to an apparatus that receives a preweighed charge of articles, those skilled in the art will note that the present invention is readily adapted to those devices which align elongated articles prior to weighing.

Figure 5:
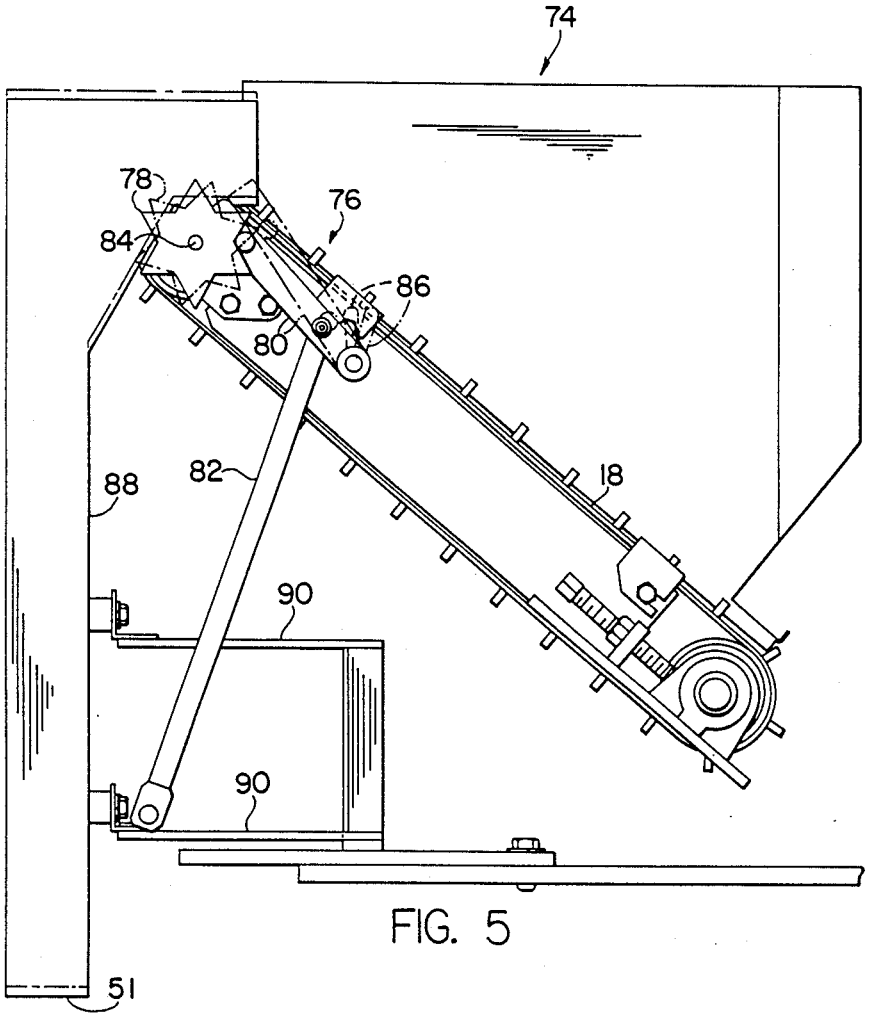
FIG. 5 is a simplified illustration of a second alternative alignment apparatus including conveyor and collector bucket vibratory mechanisms provided according to the present invention.

Referring now to FIG. 5, there is shown a partial illustration of a second alternative alignment apparatus 74 including conveyor and collector bucket vibratory mechanisms provided according to the present invention. The second alternative alignment apparatus 74 is similar to the apparatus 10 detailed with respect to FIG. 1, and further comprises a vibratory mechanism 76 configured with the endless belt 18 for imparting a vibratory motion to the flights on the belt. The action of the mechanism 76 serves to accelerate the alignment of the articles on the flights and increase the packaged product density.

The mechanism 76 is comprised of a "star" wheel cam 78 and two mechanical link arms 80 and 82. The star wheel is bolted to an end of a rotation shaft 84 shaft of an upper pulley in the conveyor mechanism and derives its rotation from this shaft. The rotation of the star wheel causes a single blade impeller 86 to be urged against the underside of the belt such that the articles on the belt tend to fall across the width of the belt in and aligned with the flights.

Secondly, collector bucket 88 is moved up and down with a jarring motion, causing the articles to settle in the bucket. The collector bucket 88 is supported by four flexible supports 90 which permit this motion. This auxiliary vibratory action tends to remove voids between the stored articles prior to delivery to a packaging machine (not shown). The frequency of the vibration imparted by the mechanism 76 should be approximately between 50 and 400 Hz. Although shown in FIG. 5 to vibrate the entire collector bucket, those skilled in the art will note that other embodiments are contemplated by the present invention, including those wherein only a portion of the collector bucket, such as the door 51 are moved. Similarly, the present invention contemplates vibratory mechanisms such as a motor and eccentric cam which vibrate the endless belt or the collector bucket or both.

The vibratory mechanisms described hereinabove allow an alignment apparatus provided according to the present invention to be operated at higher rates of speed than would otherwise be possible. Prior to the present invention, it was thought that vibration would have a negative effect on the effectiveness of the alignment apparatus since it was thought that vibration would shake off a large number of the articles from the conveyor and that vibration would otherwise be ineffective in enhancing collector bucket discharge speed due to the weight of the stored articles in the collector bucket. However, a vibratory mechanism provided by the present invention provides a significant improvement in article alignment speed with a minimal increase in cost.

We claim:

1. An apparatus for aligning a charge of elongated articles before presentation to a bagging machine, said apparatus comprising:

a bucket for receiving the charge within an interior cavity thereof;

a conveyor means comprising a side wall of said bucket interior cavity substantially encompassing the vertical extent thereof, said conveyor means having a plurality of spaced flights each adapted to receive a portion of the charge from said receiver bucket at a first conveyor position, said conveyor means for advancing said charge portion on said flights to a conveyor second position with the articles of said charge portion having the elongated dimension thereof substantially parallel to a longitudinal axis of said flights;

a collector bucket for receiving said aligned charge portions at said conveyor means second position and storing said received portions in alignment with said flight longitudinal axis; and a means for discharging said aligned charge to the bagging machine when said collector bucket has received all of said charge.

2. The apparatus of claim 1 wherein said conveyor means comprises an endless belt having said flights configured thereon, said flights advancing from said conveyor means first position to an elevated conveyor means second position such that said conveyor belt means forms an acute angle with respect to a vertical plane.

3. The apparatus of claim 2 wherein said acute angle approximately comprises 40 degrees.

4. The apparatus of claim 1 wherein said flights are spaced along said conveyor means by an amount less than the length of the elongated articles.

5. The apparatus of claim 1 wherein said flights extend outward from the conveyor means by an amount less than or equal to the height of the elongated articles.

6. The apparatus of claim 2 wherein said conveyor belt speed is adjusted so that the articles free-fall into said collector bucket.

7. The apparatus of claim 2 wherein said conveyor belt is configured within said receiving bucket.

8. The apparatus of claim 7 wherein said conveyor belt comprises an interior wall of said receiving bucket.

9. The apparatus of claim 1 wherein said discharging means further comprises a piston for displacing the closed bottom end of said collector bucket towards a bagging machine having a formed plastic pouch.

10. The apparatus of claim 1 wherein said discharging means comprises a pair of addressable bucket doors for providing said charge to a vertical formed fill and seal machine.

11. The apparatus of claim 1 wherein said collector bucket is configured to have an interior volume greater at a discharge end of said collector bucket than at a receiving end.

12. The apparatus of claim 1 wherein said receiving bucket and collector bucket comprise rigidized materials.

13. The apparatus of claim 2 further comprising a means configured with said conveyor means for imparting vibratory motion to said elongated articles.

14. The apparatus of claim 13 wherein said vibratory means comprises an eccentric cam configured with said endless belt.

15. The apparatus of claim 2 further comprising a means configured with said collector bucket for imparting vibratory motion to said aligned charge portions.

16. The apparatus of claim 15 wherein said vibratory means comprises an eccentric cam and motor configured with said collector bucket.

17. An apparatus for aligning a charge of elongated articles before presentation to a bagging machine, said apparatus comprising:

a bucket for receiving the charge:

a conveyor means having a plurality of spaced flights each adapted to receive a portion of the charge from said receiver bucket at a first conveyor position, said conveyor means for advancing said charge portion on said flights to a conveyor second position with the articles of said charge portion having the elongated dimension thereof substantially parallel to a longitudinal axis of said flights;

a means configured with said conveyer means for imparting vibratory motion to said elongated articles comprising a star wheel affixed to a conveyor means rotating shaft; and a rod mechanism for cooperating with said star wheel including a first rod for engaging an outer perimeter surface of said star wheel and a second rod having an impeller affixed to a first end thereof for contacting said endless belt and a second end configured to contact an outer wall of said collector bucket, said first rod engaging a portion of said second rod so as to impart thereto a reciprocating motion in accordance with the rotation of said star wheel.

a collector bucket for receiving said aligned charge portions at said conveyor means second position and storing said received portions in alignment with said flight longitudinal axis; and a means for discharging said aligned charge to the bagging machine when said collector bucket has received all of said charge.

18. A system for aligning a charge of elongated articles before presentation to a bagging machine, said system comprising:

a plurality of alignment devices configured in an array, said array having a first position for receiving the charge and a second position for discharging the charge into the bagging machine, each device including a bucket for receiving the charge, a conveyor means having a plurality of spaced flights each adapted to receive a portion of the charge from said receiving bucket at a first conveyor position, said conveyor means for advancing said charge portion on said flights to a conveyor second position with the articles of said charge portion having the elongated dimension thereof aligned substantially parallel to a longitudinal axis of said flights, a collector bucket for receiving the aligned charge in a selected time period and maintaining said received charge in alignment with said flight longitudinal axis;

a means for selectively discharging the aligned stored charge; and a means for repetitively advancing each of said devices between said first and second array positions in a time period approximately equal to said collector time period.

19. The system of claim 18 further comprising an indexing table receiving said alignment device array on a surface thereof, said indexing table moving said alignment devices between said first and second device positions.

20. The system of claim 18 wherein said conveyor means comprises an endless belt having said flights configured thereon, said flights advancing from said conveyor means first position to an elevated conveyor means second position such that said conveyor means belt forms an acute angle with respect to a vertical plane.

21. The system of claim 20 wherein said acute angle approximately comprises 40 degrees.

22. The system of claim 20 wherein said flights are spaced along said conveyor means by an amount less than the length of the elongated articles.

23. The system of claim 20 wherein said flights extend outward from the conveyor means belt by an amount less than or equal to the height of the elongated articles.

24. The system of claim 20 wherein said conveyor belt speed is adjusted so that the articles free-fall into said collector bucket.

25. The system of claim 20 wherein said conveyor belt is configured within said receiving bucket.

26. The system of claim 25 wherein said conveyor belt comprises an interior wall of said receiving bucket.

27. The system of claim 18 wherein said discharging means further comprises a piston for displacing the closed end of said collector bucket towards a bagging machine having a formed plastic pouch.

28. The system of claim 18 wherein said discharging means comprises a pair of addressable bucket doors for providing said charge to a vertical formed fill and seal machine.

29. The system of claim 20 further comprising a means configured with said conveyor means for imparting vibratory motion to said elongated articles.

30. The system of claim 29 wherein said vibratory means comprises an eccentric cam configured with said endless belt.

31. The system of claim 29 wherein said vibratory means comprises:

a star wheel affixed to a conveyer means rotating shaft; and a rod mechanism for cooperating with said star wheel including a first rod for engaging an outer perimeter surface of said star wheel and a second rod having an impeller affixed to a first end thereof for contacting said endless belt and a second end configured to contact an outer wall of said collector bucket, said first rod engaging a portion of said second rod so as to impart thereto a reciprocating motion in accordance with the rotation of said star wheel.

32. The system of claim 20 further comprising a means configured with said collector bucket for imparting vibratory motion to said aligned charge portions.

33. The system of claim 32 wherein said vibratory means comprises an eccentric cam and motor configured with said collector bucket.

34. An apparatus for aligning charges of elongated articles before presentation to a bagging machine, said apparatus comprising:

a hopper means for providing a sequence of charges to a plurality of alignment devices configured in an array, each device including a bucket for receiving the charge, a conveyor means having a plurality of spaced flights each adapted to receive a portion of the charge from said bucket at a first conveyor position, said conveyor means for advancing said charge portion on said flights to a conveyor second position with the articles of said substantially parallel to a longitudinal axis of said flights, a collector bucket for receiving the aligned charge in a selected time period and maintaining said received charge in alignment with said flight longitudinal axis;

a means for selectively discharging the aligned stored charge; and a means configured with each of said devices for repetitively moving said hopper means between said first and second array positions in a time period approximately equal to said collector time period, thereby allowing said received charge to be aligned and stored in said collector bucket before discharge to the bagging machine.

35. The apparatus of claim 34 wherein said alignment devices further comprise a means configured with said collector bucket for imparting vibratory motion to said articles.

36. A method for aligning a charge of elongated articles before presentation to a bagging machine comprising the steps of:

receiving the charge in a bucket having a conveyor means comprising a side wall of said bucket interior cavity substantially encompassing the vertical extent thereof, said conveyor means, said conveyor means with a plurality of spaced flights each adapted to receive a portion of the charge from said receiving bucket at a first conveyor position;

advancing said charge portion on said flights to a conveyor second position with the articles of said charge portion having the elongated dimension thereof substantially parallel to a longitudinal axis of said flights; and providing said aligned charge portions to a collector bucket at said conveyor means second position and storing said received portions in alignment with said flight longitudinal axis; and discharging said charge to the bagging machine when said collector bucket has received all of said charge.

37. A method for aligning a charge of elongated articles before presentation to a bagging machine comprising the steps of:

configuring a plurality of alignment devices in an array, said array having a first position for receiving the charge and a second position for discharging the charge into the bagging machine, each device receiving the charge in a bucket having a conveyor means with a plurality of spaced flights each adapted to receive a portion of the charge from said receiver bucket at a first conveyor position;

advancing said charge portion on said flights to a conveyor second position with the articles of said charge portion having the elongated dimension thereof aligned substantially parallel to a longitudinal axis of said flights;

providing the aligned charge in a collector bucket during a selected time period and maintaining said received charge in alignment with said flight longitudinal axis;

selectively discharging the aligned and stored charge; and repetitively advancing each of said devices between said first and second array positions in a time period approximately equal to said collector time period.

* * * * *